United States Patent [19]

Ernst et al.

[11] Patent Number: 4,683,940

[45] Date of Patent: Aug. 4, 1987

[54] UNIDIRECTIONAL HEAT PIPE

[75] Inventors: Donald M. Ernst, Leola; Jerome E. Toth, Hatboro, both of Pa.

[73] Assignee: Thermacore, Inc., Lancaster, Pa.

[21] Appl. No.: 886,218

[22] Filed: Jul. 16, 1986

[51] Int. Cl.[4] ..... F28F 27/00; F23D 15/00

[52] U.S. Cl. ..... 165/32; 165/104.26

[58] Field of Search ..... 165/104.26, 32

[56] References Cited

U.S. PATENT DOCUMENTS

| | | | |
|---|---|---|---|
| 3,587,725 | 6/1971 | Basiulis | 165/104.26 |
| 3,613,774 | 10/1971 | Bliss | 165/104.26 |
| 3,700,028 | 10/1972 | Noren | 165/104.26 |
| 4,007,777 | 2/1977 | Sun et al. | 165/104.26 |
| 4,058,159 | 11/1977 | Iriarte | 165/104.26 |
| 4,058,160 | 11/1977 | Corman et al. | 165/104.26 |
| 4,116,266 | 9/1978 | Sawata et al. | 165/104.26 |
| 4,336,837 | 6/1982 | Koenig | 165/104.26 |
| 4,441,548 | 4/1984 | Franklin et al. | 165/104.26 |

*Primary Examiner*—Albert W. Davis, Jr.

*Attorney, Agent, or Firm*—Martin Fruitman

[57] ABSTRACT

A heat pipe with limited heat transfer capabilities in one direction. The heat pipe, which transfers heat in one direction in normal fashion, also transfers heat in the reverse direction, but only up to a prescribed point, beyond which the reverse heat flow cuts off. It operates because of the use of a limited liquid filling and at least one artery which is closed at the normal evaporator end and open ended at the normal condenser end.

2 Claims, 1 Drawing Figure

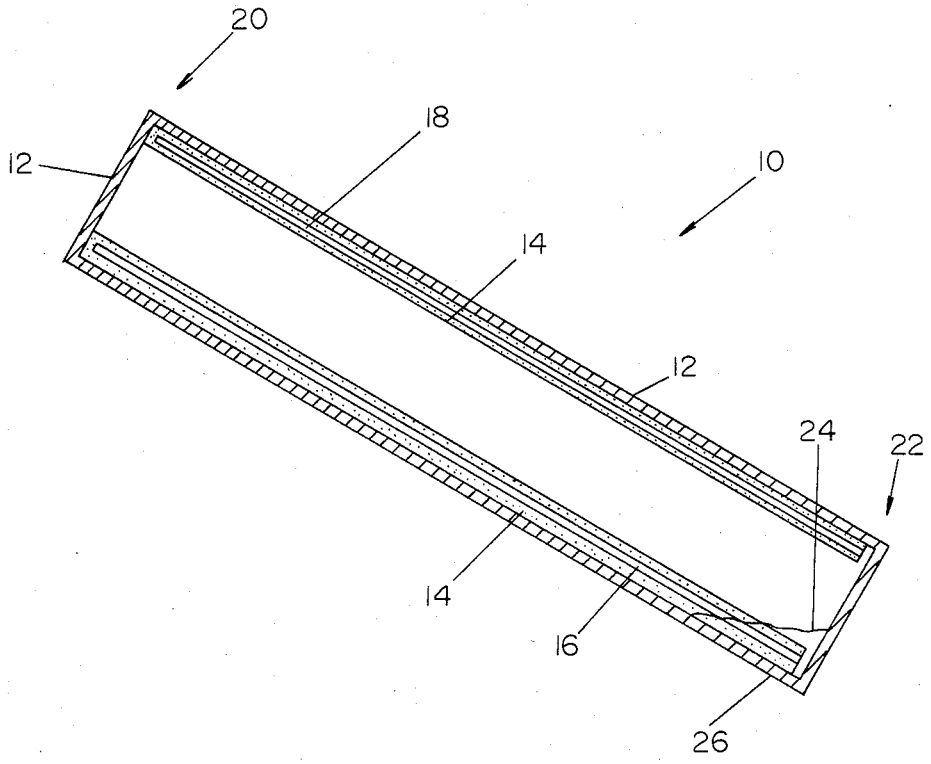
20
18
12
10
14
12
24
22
14
16
26

UNIDIRECTIONAL HEAT PIPE

SUMMARY OF THE INVENTION

This invention deals generally with heat transfer and more specifically with a heat pipe designed to limit heat transfer in one direction while permitting free heat transfer in the other direction.

Unidirectional heat transfer is a frequent goal in many applications. Its major benefit is the ability to heat or cool a device without the risk of the intended heat transfer path transferring heat in the opposite direction to negate the design goals. A simple example of such an application is that of heating a greenhouse with sunlight passing through glass. When the sun goes down it is desirable to prevent loss of the heat back through the glass.

In more sophisticated applications, such as in space vehicles, a similar phenomenum can occur when cooling electronic devices by transferring heat to the shaded side of the vehicle. In such an application it is desirable to assure that, if the normally shaded side of the vehicle turns to the sun, the electronic devices, while not being cooled, are also not overheated by the sun's heat and therefore damaged.

Heat pipes are used for both heating and cooling in industrial and space applications because they are so effective in transferring heat, but this very effectiveness raises the danger that, particularly during a malfunction of the equipment, a heat pipe may transfer heat to a device being cooled, or cool a device which demands heat.

The present invention deals with just that problem. It results in a heat pipe which transfer heat normally in a forward direction, and, within limits prescribed by its design, also transfers only limited heat in the reverse direction. Moreover, when the prescribed limit of reverse heat flow is surpassed, the reverse heat flow stops entirely.

This operation is accomplished by, first, using a limited supply of liquid in the heat pipe and, second, specially designing the liquid arteries within the heat pipe so that the arteries are not sealed off at the normal condenser end.

Since the capillary pumping capability of an artery is limited by the size of its largest opening, an open-ended artery has very minimal capillary pumping ability. It is this phenomenum which is used to control the reverse heat transfer capability of the present invention.

It is well understood in the heat pipe art that on limitation on the power a heat pipe can transfer is caused by the "drying out" of the evaporator of the heat pipe. This situation occurs when heat is being applied to the evaporator at such a rate that the heat pipe liquid transport system is incapable of returning liquid fast enough from the condenser to the evaporator. In effect the liquid is evaporated from the heat input side, and the liquid return system does not operate well enough to assure that the vapor is condensed and returned to the evaporator, so the evaporator has no more liquid to evaporate and the heat transfer action ceases.

The simplest example of such a malfunction might be a gravity return heat pipe, one in which the evaporator is below the condenser so that the liquid simply runs down the inside of the casing from the condenser to the evaporator. If such a heat pipe is tilted to place the evaporator above the condenser, the liquid return mechanism no longer operates, the evaporator drys out and the heat transfer action stops.

In the present invention a different mechanism is used, but the reverse heat transfer is similarily limited by lack of liquid delivery to the reverse evaporator. The mechanism used to limit liquid delivery is the open-ended capillary artery previously mentioned, and the key to operation is that the artery end is kept sealed by the heat transfer liquid itself when the heat pipe is operating in its normal direction, but is opened up by liquid evaporation when heat transfer in the reverse direction surpasses a predetermined limit. When the artery becomes open-ended, liquid is no longer returned to the reverse direction evaporator, the normal condenser, and the reverse heat transfer stops.

The present invention therefore furnishes a unidirectional heat pipe with a very simple mechanical structure which operates reliably largely because no additional mechanical devices are added to the heat pipe.

BRIEF DESCRIPTION OF THE DRAWING

THE FIGURE shows an axially cross section view of the preferred embodiment of the heat pipe of the present invention.

DETAILED DESCRIPTION OF THE INVENTION

The FIGURE shows the preferred embodiment of the invention in an axial cross section view in which heat pipe 10 is constructed with sealed evacuated casing 12 and internal wick structure 14 within which are located arteries 16 and 18.

The structure of heat pipe 10 is extremely simple, and its novelty arises from the fact that arteries 16 and 18 are constructed to be sealed off at normal evaporator end 20 of heat pipe 10 while they are constructed as open ended at normal condenser end 22 of heat pipe 10.

Additionally, heat transfer liquid 24 is placed into heat pipe 10 in a limited quantity so that in normal use with heat being applied to normal evaporator 20, and considering the total amount of liquid retained within wick 14 and arteries 16 and 18, sufficient liquid will accumulate in liquid retainer 26 at condenser end 22 to seal off at least one of the arteries. In the preferred embodiment of the invention liquid retainer 26 is simply the lowest portion of tilted heat pipe 10. The liquid accumulation can not, however, be excessive, since the quantity of liquid normally accumulated is what determines the limit of heat transfer in the reverse direction.

The present invention uses a particularly simple system for changing arteries 16 and 18 from closed to open-ended arteries. The mechanism used is heat pipe liquid 24 itself. Heat pipe 10 is designed and its liquid fill 24 measured so that, during normal operation and for limited reverse heat flow, heat transfer liquid 24 accumulates in liquid retainer 26 at normal condenser 22 in such quantities that it floods and closes off the ends of at least one artery. With the normal evaporator end of an artery originally constructed as closed off, and the normal condenser end closed off by the accumulated liquid, the artery functions in its prescribed manner and moves liquid from normal condenser 22 to the normal evaporator 20.

However, when the heat input is changed to normal condenser 22 to make it the reverse evaporator, the limitations of the present invention become effective. As liquid 24 is evaporated from reverse evaporator 22 and condensed at normal evaporator 20, which is then the reverse condenser, accumulated liquid 24 at reverse evaporator 22 is depleted until, at the prescribed design point, the liquid no longer seals off the ends of any arteries. At this point of operation the liquid flow to the reverse evaporator through the arteries stops, and the drying out process accelerates dramatically. Heat transfer from reverse evaporator 22 then quickly terminates as reverse evaporator 22 completely drys out.

By the simple combination of arteries which are mechanically unsealed at the normal condenser and regulation of the liquid quantity in the heat pipe to provide for only sufficient liquid to flood and seal off the open arteries, the present invention provides a heat pipe which dramatically limits reverse heat transfer.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, liquid retainer 26 need not make use of gravity, but could use centrifugal force or other means to accumulate sufficient liquid to flood the open ends of the arteries. In a gravity free environment the force resulting from vapor movement alone is sufficient to sweep liquid to the condenser region and hold it there. Moreover, the arteries could be constructed of screen material formed into cylinders.

What is claimed as new and for which Letters Patent of the United States desired is:

1. A heat pipe with normal heat transfer in a forward direction and limited heat transfer in the reverse direction comprising:

a sealed evacuated casing with a normal evaporator and a normal condenser used for heat transfer in the forward direction;

at least one liquid pumping capillary artery structure with a sealed end located at the normal evaporator of the heat pipe casing and an open end located at the normal condenser of the heat pipe casing;

a liquid retaining means located at the normal condenser of the heat pipe, the liquid retaining means oriented so that liquid retained within it closes off the open end of the artery structure; and heat transfer liquid located within the casing in at least sufficient quantity so that, during heat transfer in the forward direction, sufficient liquid accumulates in the liquid retaining means to close off the open end of the artery structure.

2. The heat pipe of claim 1 wherein the quantity of liquid within the casing is limited to an amount which will cause the liquid in the liquid retaining means to be depleted if heat is applied to the normal condenser of the heat pipe casing.

* * * * *